US006416456B2

(12) United States Patent
Zanella et al.

(10) Patent No.: US 6,416,456 B2
(45) Date of Patent: Jul. 9, 2002

(54) METHOD FOR THE AUTOMATIC CONTROL OF A BLOOD CENTRIFUGE

(75) Inventors: Andrea Zanella, Mirandola; Massimo Belloni, Isola Della Scala VR; Guido Comai, Budrio Bo; Ivo Panzani, Mirandola, all of (IT)

(73) Assignee: Dideco S.p.A. (IT)

( * ) Notice: Subject to any disclaimer, the term of this patent is extended or adjusted under 35 U.S.C. 154(b) by 0 days.

(21) Appl. No.: 09/873,584

(22) Filed: Aug. 13, 1999

Related U.S. Application Data

(63) Continuation of application No. 09/366,989, filed on Aug. 4, 1999, now Pat. No. 6,241,649.

(30) Foreign Application Priority Data

Jul. 8, 1998 (IT) ..... MI98A1877

(51) Int. Cl.[7] ..... B04B 13/00
(52) U.S. Cl. ..... 494/37
(58) Field of Search ..... 494/1, 5, 6, 10, 494/11, 37, 41, 42, 43; 210/104, 143, 782, 787

(56) References Cited

U.S. PATENT DOCUMENTS 5,298,171 A * 3/1994 Biesel
5,311,908 A * 5/1994 Barone et al.
5,379,775 A * 1/1995 Kruse
5,383,911 A * 1/1995 Mann
5,385,539 A * 1/1995 Maynard
5,417,715 A * 5/1995 Noren et al.
5,423,738 A * 6/1995 Robinson et al.
5,607,579 A * 3/1997 Latham, Jr. et al.
5,730,883 A * 3/1998 Brown
5,876,611 A * 3/1999 Shettigar
5,919,125 A * 7/1999 Berch

* cited by examiner

*Primary Examiner*—Charles E. Cooley
(74) *Attorney, Agent, or Firm*—Popovich & Wiles, PA

(57) ABSTRACT

A method and an apparatus for the automatic control of a blood centrifuge, including a controller that processes four input values and two output parameters. The four input values include the hematocrit value of the input blood, the volume of the red cells present in the centrifuge, the filling level of the centrifuge, and, selectively, the hematocrit value for collected blood at the end of the filling step and the time required for the filling step. The two output parameters include the flow rate of the blood into the centrifuge and either the time required for the filling step (when the hematocrit value is provided as input) or the predicted hematocrit value (when the time for the filling step is provided as input).

5 Claims, 2 Drawing Sheets

METHOD FOR THE AUTOMATIC CONTROL OF A BLOOD CENTRIFUGE

This is a continuation of application Ser. No. 09/366,989, now U.S. Pat. No. 6,241,649, filed Aug. 4, 1999, the contents of which are hereby incorporated herein by reference.

FIELD OF THE INVENTION

The present invention relates to a method and an apparatus for the automatic control of a blood centrifuge.

BACKGROUND OF THE INVENTION

The hematocrit value is the percentage of the volume of the blood that is occupied by red blood cells. During some medical procedures, such as, for example, autotransfusion during or after surgery, there is a need to increase the blood's hematocrit value. Increasing the blood's hematocrit value is currently performed in blood centrifuges where blood is introduced by a peristaltic pump.

A blood centrifuge substantially comprises two coaxial and rigidly coupled bell-shaped chambers arranged with one inside the other. The portion of space between the two chambers defines a cell that receives the blood. The cell is connected to the outside by an inlet tube and a discharge tube. The inlet tube and discharge tube are connected to the bell-shaped chambers by a rotary coupling. The blood centrifuge rotates the chambers about their axis while the tubes are kept motionless.

The centrifugation procedure entails a first step of filling the cell. The cell is filled by introducing blood through the inlet tube. The centrifugal force propels the blood away from the rotational axis. The blood centrifuge packs the red blood cells in the cell against the wall of the outer chamber. The red blood cells pack against the outer wall because they are more dense than the blood's other components. Other cellular components, such as white blood cells and platelets, are arranged in a thin layer known as buffy coat directly adjacent to the mass of packed red cells. The buffy coat assumes an orientation substantially parallel to the centrifuge's rotational axis. The separated plasma, the remaining component of blood, is arranged in a layer which lies above the buffy coat closer to the rotation axis. As filling continues, the buffy coat moves closer to the rotation axis displacing the separated plasma toward the discharge tube. When the plasma reaches the discharge tube the plasma flows out of the cell into an adapted collection bag. The outgoing flow of plasma continues until an optical sensor detects that the buffy coat has reached the discharge tube indicating the centrifuge is full. When the buffy coat reaches the discharge tube the filling step is complete. No additional blood is introduced into the centrifuge. The centrifuge now contains almost exclusively packed red cells and the buffy coat, since the separated plasma has been almost completely displaced from the cell.

Optionally, the filling step is followed by a washing step for the red blood cells and by an emptying step during which the cells are collected in a suitable bag. In any case, the invention relates to the filling step because the hematocrit value of the blood after filling remains substantially unchanged during the subsequent steps.

After the filling step, the hematocrit value of the collected blood is higher than the hematocrit value of the input blood. The hematocrit value of the collected blood varies with each centrifugation. The collected blood's hematocrit value depends on the trend of the input blood's hematocrit value over time, which is normally variable, and the flow rate of blood into the cell. For example, a low flow rate allows a high degree of packing of the red cells, with a high hematocrit value, but entails a long filling time which is sometimes incompatible with emergency conditions; or, alternatively, a high flow rate reduces the procedure time but the collected blood's hematocrit value is typically only slightly higher than the input blood's hematocrit value.

The flow rate of input blood is the only directly controllable variable for blood centrifugation during the filling step. Therefore, the flow rate is altered to adapt the collected blood to specific requirements. There is currently no system for automatically controlling the operation of a blood centrifuge. An operator typically controls the flow rate by adjusting the pump based on experience. The operator determines how the flow rate should be adjusted by continuously monitoring the centrifugation or by choosing among a certain number of predefined procedures, but these techniques have drawbacks. The drawbacks can include an inaccuracy in the result and considerable direct involvement of the operator. In any case, final hematocrit value and the time for centrifugation have never been predictable.

SUMMARY OF THE INVENTION

The aim of the present invention is to provide an apparatus and a method for the automatic control of a blood centrifuge. More particularly, the present invention provides a system for controlling the flow rate of the blood fed into the centrifuge. The system is capable of obtaining a specific hematocrit value for the collected blood with a forecast of the time required for the centrifugation procedure. Alternatively, the system is capable of ensuring completion of the operation in a very specific time with a forecast of the hematocrit value collected blood at the end of the procedure.

In one aspect, this invention is a method for the automatic control of a blood centrifuge wherein blood is added to the centrifuge in a filling step and red blood cells are separated from the blood in a settling process the method comprising providing a blood centrifuge, a blood pump for communicating blood to the centrifuge and a controller configured to receive data and to produce at least one output; providing first input data to the controller indicative of a selected output parameter comprising one of a desired hematocrit value for blood after completion of the filling step and a desired time required to complete the filling step; providing second input data to the controller indicative of a hematocrit value of blood entering the blood centrifuge; providing third input data indicative of a level of packed red blood cells in the blood centrifuge to the controller; providing fourth input data to the controller indicative of a volume of red blood cells in the centrifuge; and processing the first, second, third and fourth input data in the controller to produce a first output for controlling blood flow rate through the pump during the filling step.

The first, second, third and fourth input data in the controller may be processed to produce a second output comprising one of an output indicative of time required for completion of the filling step, if the first input data is a desired hematocrit value for blood after the filling step, and an output indicative of the hematocrit value at the end of the filling step, if the first input data is a desired time for completing the filling step.

The controller may process the input data using a neural network, or by using experimentally obtained input data and output parameters. In addition, the controller may process the input data using both the input data and the output parameters that govern the settling process, or it may process the input data based on analytic or numerical solution of the input data and output parameters that govern the settling process. The controller may also process the input data using a generic mathematical function, optimized for the purpose experimentally or optimized on the basis of input data and output parameters governing the settling process.

The third input data indicative of the level of packed red blood cells may be provided by a buffy coat level sensor. The second input data indicative of a hematocrit may be provided by a hematocrit sensor.

The third input data for the level of packed red blood cells may be calculated using an algorithm based on the flow rate of a pump providing input blood to the centrifuge and the hematocrit value of the input blood.

The fourth input data to the controller indicating the volume of red blood cells in the centrifuge may be provided by a processing unit.

In another aspect, this invention is an apparatus for the automatic control of a blood centrifuge wherein blood is added to the centrifuge in a filling step and red blood cells are separated from the blood in a settling process, the apparatus comprising a blood pump communicating blood to the centrifuge; a first sensor configured to measure a hematocrit value of blood entering the blood centrifuge and produce data indicative of the hematocrit value; a second sensor configured to measure a level of packed red blood cells during centrifugation and produce data indicative of the level of packed red blood cells; a processing unit for producing data indicative of a volume of red blood cells in the centrifuge; an operator interface for producing data indicative of a selected output parameter comprising one of a desired hematocrit value for blood after completion of the filling step and a desired time required to complete the filling step; and a controller configured to receive the data from the first and second sensors, the processing unit and the operator interface, in order to produce a first output for controlling blood flow rate to achieve the selected output parameter. The controller may be further configured to produce a second output comprising one of an output indicative of time required for completion of the filling step, if the selected parameter of the first input data is a desired hematocrit value for blood after the filling step, and an output indicative of the hematocrit value at the end of the filling step, if the selected parameter of the first input data is a desired time for completing the filling step. The controller may be further configured to receive data indicative of a flow rate of blood and a volume of red blood cells.

Further characteristics and advantages of the present invention will become apparent from the following detailed description as illustrated in the accompanying drawings.

DETAILED DESCRIPTION OF THE PREFERRED EMBODIMENTS

Figure 2:
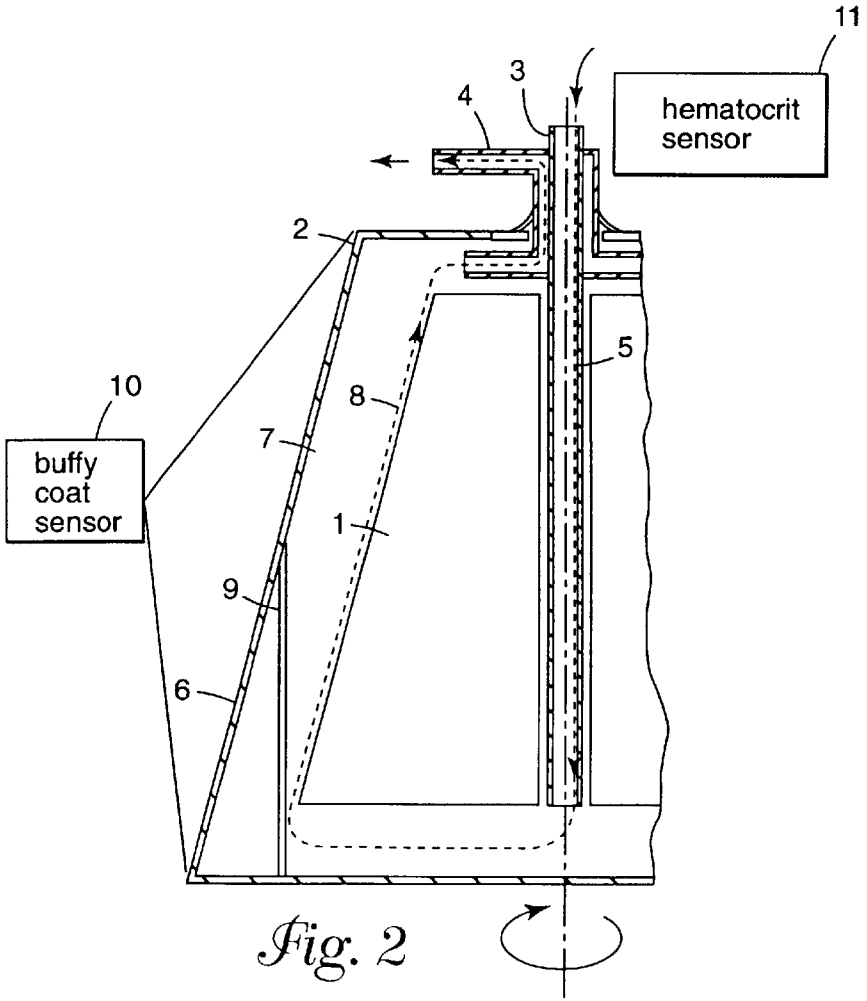
FIG. 2 is a schematic partial view of the centrifuge during filling.
Figure 1:
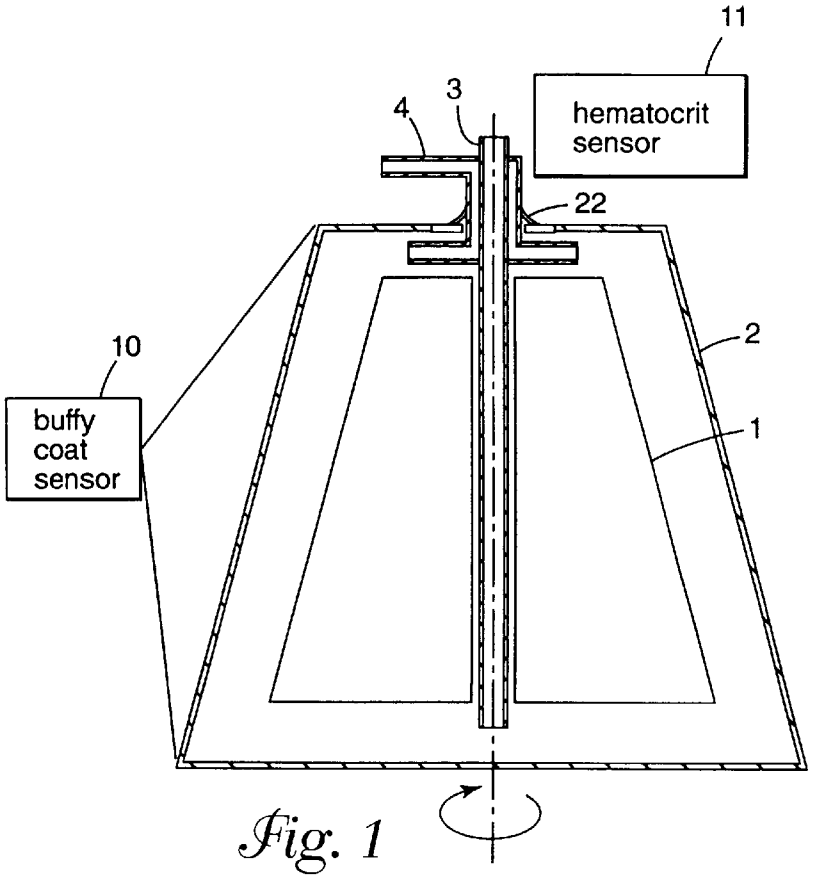
FIG. 1 is a schematic view of the centrifuge.

The aim of the present invention is achieved by a system for the automatic control of a blood centrifuge. The system comprises a controller that is capable of processing input data and output parameters. Preferably, the controller processes four input values and two output parameters. The four input values or vectors include:

the hematocrit value of the input blood;

the volume of the red cells present in the centrifuge;

the filling level of the centrifuge; and selectively, the hematocrit value of collected blood at the end of the filling step and the time required for said filling step, set by the operator.

The two output parameters include:

the signal that controls the flow rate of the pump that feeds the blood into the centrifuge; and selectively, the time required by the filling step, if the hematocrit value of the collected blood at the end of the filling step is provided as input; and the predicted hematocrit value of the collected blood after the filling step, if the time required for the filling step is provided in input. The controller functions as a neural network.

Moreover, the present invention is characterized by the presence of a unit that processes the flow rate of blood into the cell and the hematocrit value of the input blood to determine the volume of red blood cells in the centrifuge. The processing unit provides the volume of red blood cells to the controller as input.

There is also a sensor for the level of the buffy coat and a sensor for providing the hematocrit value. The buffy coat level sensor monitors the buffy coat level substantially over the entire range of buffy coat levels. The hematocrit sensor provides the hematocrit value of the input blood.

In FIGS. 1, 2, 3 and 5, the reference numerals 1 and 2 respectively designate the inner bell-shaped chamber and the outer bell-shaped chamber of the centrifuge. Inner chamber 1 and outer chamber 2 are mutually rigidly coupled and are rotated according to the arrow shown in the figures. The space between inner chamber 1 and outer chamber 2 forms a cell 21 for receiving the blood. The reference numerals 3 and 4 respectively designate an inlet tube and a discharge tube. Inlet tube 3 and discharge tube 4 connect cell 21 to the outside. Inlet tube 3 and discharge tube 4 are connected to the assembly of bell-shaped chambers by means of a rotary coupling 22, so as to remain motionless during rotation of the chambers.

FIG. 2 continues the earlier description of the centrifuge filling step. FIG. 2 shows the red blood cells filling cell 21 and then being separated from other blood components by centrifugal force during a settling process. The blood enters cell 21 by the action of a blood pump, not shown. The blood enters along path 5. The red blood cells are packed in region 6. Region 7 is occupied by the separated plasma that flows toward the outlet along path 8. Region 6 is separated from region 7 by buffy coat 9. Buffy coat 9 is a layer of white cells and platelets. As more red blood cells pack into region 6, buffy coat 9 is displaced toward the central rotation axis. The filling step ends when buffy coat 9 reaches discharge tube 4. At the end of the filling step the centrifuge almost exclusively contains packed red blood cells.

With reference to the FIGS. 1 to 5, there is buffy coat level sensor 10. Buffy coat level sensor 10 monitors the level of buffy coat 9 substantially over its entire range of levels. Buffy coat sensor 10 typically is an optical sensor. There is also hematocrit sensor 11. Hematocrit sensor 11 detects the hematocrit value of the input blood entering the centrifuge. Hematocrit sensor 11 typically is an optical sensor and preferably comprises two infrared light emitting diodes of different wavelength and a large bandwidth receiver photodiode.

Figure 3:
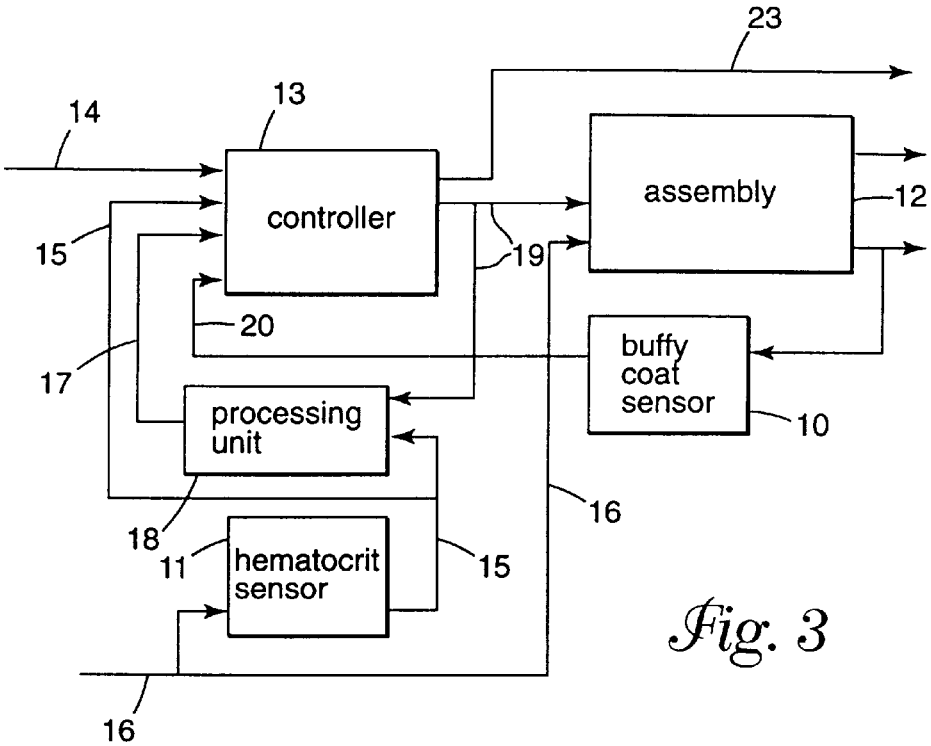
FIG. 3 is a block diagram of the automatic control system.

The diagram of a control system for the described device is shown in FIG. 3. The reference numeral 12 designates an assembly formed by the centrifuge and by the blood pump. The reference numeral 13 designates a controller. Controller 13 implements a function with four inputs and two outputs. Input 14 is the hematocrit value for the blood collected after centrifugation. Input 14 is set by the operator according to the operator's need. If necessary, the operator can vary input 14 over time. Input 15 is the hematocrit value of the blood entering into the centrifuge. Input 15 is acquired periodically from input line 16 connected to hematocrit sensor 11. Input 17 is the volume of the red blood cells in the centrifuge. Input 17 is obtained by processing unit 18. Unit 18 periodically processes the hematocrit value of input 15 and flow rate 19 from the pump that feeds the blood into the centrifuge. Thereby, processing unit 18 generates an output indicative of red blood cell volume received as input 17 by controller 13. That is, processing unit 18 calculates the volume of red blood cells using hematocrit value data and the flow rate of the blood feeding into the centrifuge. Input 20 is the level of packed red blood cells in the centrifuge. Input 20 is sent periodically by buffy coat level sensor 10.

Figure 4:
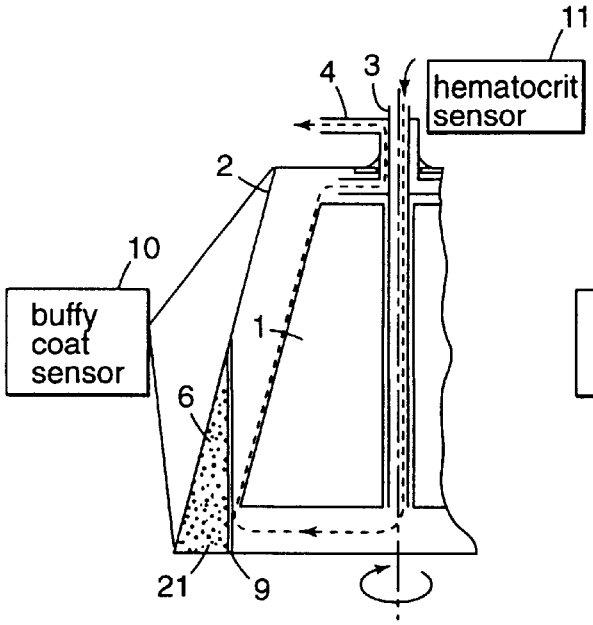
FIGS. 4 and 5 are schematic partial views of the cell during filling showing the level of packed red blood cells during filling.
Figure 5:
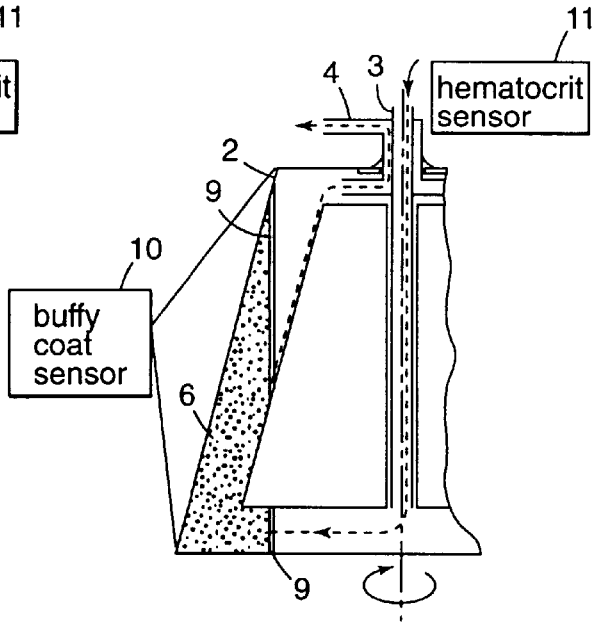

A brief digression is necessary to point out that the two values which could indicate the state of the system at any given instant. The two values are the volume of red blood cells present in the centrifuge and the level of packed red blood cells in the centrifuge, indicated by the buffy coat level. The volume of red blood cells alone would in fact not be sufficient because of variations in packing density. In FIGS. 4 and 5, the red blood cell volumes in region 6 are the same but the densities of the red blood cells are different. Thus, FIGS. 4 and 5, show the need to resort to buffy coat level 9 to remove all ambiguity in identifying the state of the system.

The description now returns to controller 13. Controller 13 evaluates the four above-described inputs at successive time intervals. Controller 13 uses the input to provide an output 19 controlling the signal that controls the blood pump's flow rate. Thereby, controller 13 optimizes flow rate after the calculation each set of input received by controller 13. Controller 13 also provides an output 23 of the time required to complete the filling step. Output 23 gives the operator useful information regarding the timeliness of continuing according to the initial criteria.

In the described example, the function implemented by controller 13 is a neural network. That is, controller 13 represents a software algorithm implementing a 4-input—2-output mathematical function. This function can be calculated in real time by a generic calculation system (i.e., a microcontroller), yielding the output vectors or parameters from the input vectors or values. The neural network is found to be particularly advantageous, but numerous embodiments of said function are possible. In one embodiment, the function implemented by controller 13 is derived from input and out put vectors obtained experimentally or from the physical equations that govern the settling process. In another embodiment, the function implemented by controller 13 is based on the analytic or numerical solution of the physical equations that govern the settling process. In still another embodiment, the function implemented by controller 13 is a generic mathematical function. The generic mathematical function is optimized for the purpose through experimental work or on the basis of the physical equations that govern the settling process.

A control system has been provided which is capable of optimizing, substantially moment by moment, the flow rate from the blood pump to the centrifuge. The control system allows the operator to specify a hematocrit value for collected blood at the end of the filling step. The system then provides a forecast of the time required to complete the filling step.

Alternatively, the control system allows the operator to designate the required to complete the filling step. In this embodiment, input 14 is the time to complete the filling step input by the user. Output 23 is changed to indicate the predicted hematocrit value for the collected blood at the end of the filling step.

The described invention is susceptible of other modifications and variations which are within the scope of the inventive concept. Thus, for example, buffy coat level sensor 10 may be omitted if the buffy coat level is determined by an algorithm as a function of the hematocrit value and of the input blood flow rate. Hematocrit sensor 11 on blood inlet tube 3 can also be omitted if the hematocrit value is determined with different means. It is also possible for the operator to enter the hematocrit value into the system.

Various modifications and alterations to this invention will become apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims set forth herein as follows.

What is claimed is:

1. A method of determining the status, including level and volume, of red blood cells in a blood centrifuge, comprising:

providing a blood centrifuge, a blood pump for communicating blood to the centrifuge and a processing unit;

providing first data to the processing unit indicative of a hematocrit value of blood entering the centrifuge;

providing second data to the processing unit indicative of a flow rate of blood entering the centrifuge;

processing the first and second data in the processing unit to produce a first output indicative of the volume of red blood cells in the centrifuge;

providing a level sensor; and measuring with the level sensor a level of red blood cells in the centrifuge, the level sensor producing a second output indicative of the level of red blood cells in the centrifuge.

2. The method of claim 1 wherein the first data is provided by a hematocrit sensor.

3. The method of claim 1 wherein the level sensor measures the level of a buffy coat.

4. A method of determining the volume of red blood cells in a blood centrifuge, comprising:

providing the centrifuge, a pump, and a controller;

providing first data to the controller indicative of a hematocrit value of blood entering the centrifuge;

providing second data to the controller indicative of a flow rate of blood entering the centrifuge; and processing the first and second data in the controller to produce an output indicative of the volume of red blood cells in the centrifuge.

5. The method of claim 4 wherein the first data is provided by a hematocrit sensor.

* * * * *